United States Patent [19]

Camarena

[11] 4,301,545

[45] Nov. 24, 1981

[54] ADJUSTABLE SWIMSUIT

[76] Inventor: Virginia Camarena, 8601 International Ave., #167, Canoga Park, Calif. 91304

[21] Appl. No.: 79,098

[22] Filed: Sep. 26, 1979

[51] Int. Cl.[3] ..... A41D 5/00

[52] U.S. Cl. ..... 2/67

[58] Field of Search ..... 2/67

[56] References Cited

U.S. PATENT DOCUMENTS 1,814,451 7/1931 Neveu ..... 2/67

FOREIGN PATENT DOCUMENTS 425948 3/1931 United Kingdom ..... 2/67

430790 6/1935 United Kingdom ..... 2/67

*Primary Examiner*—Doris L. Troutman

*Attorney, Agent, or Firm*—Joseph R. Evanns

[57] ABSTRACT

An adjustable swimsuit for women comprises an upper piece and a lower piece. The upper and lower pieces are adjustably connectable by the wearer to provide selected exposure, and particularly concealment, of imperfections in the skin as, for example, surgical scars.

5 Claims, 5 Drawing Figures

Fig. 1.
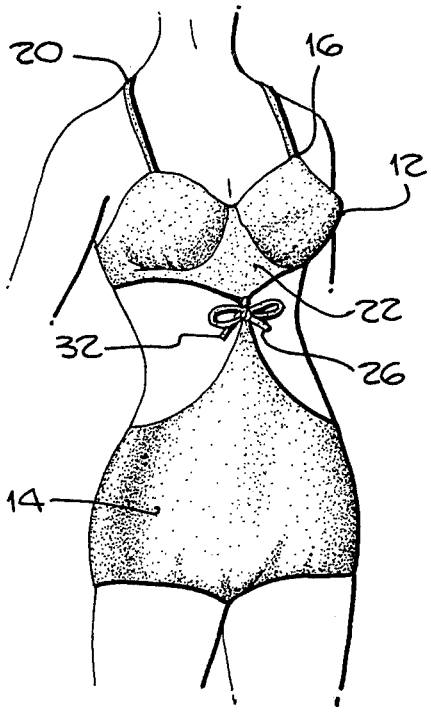
Fig. 2.
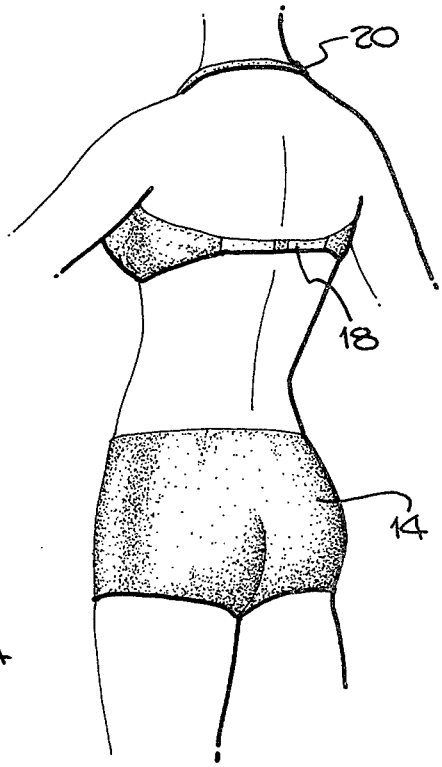
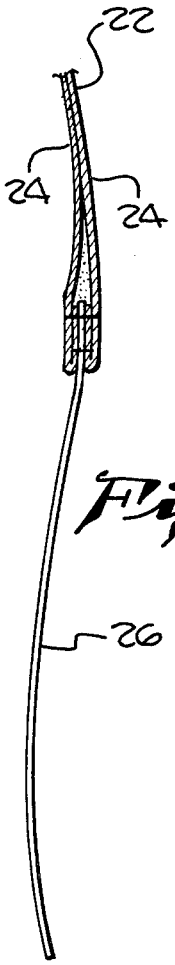
Fig. 3.
Fig. 5.
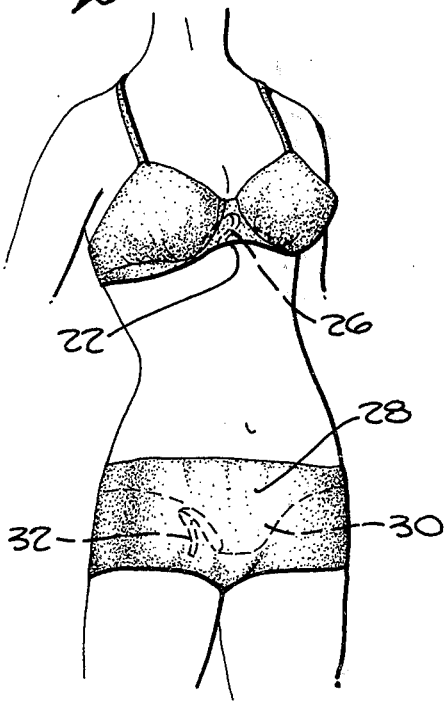
Fig. 4.
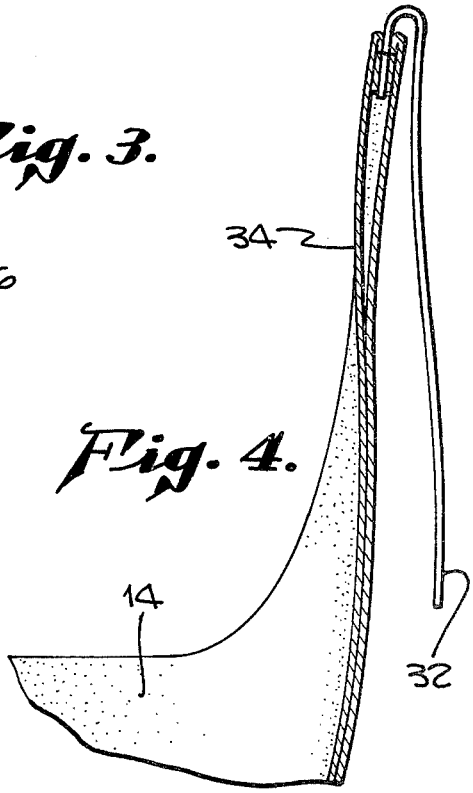

ADJUSTABLE SWIMSUIT

BACKGROUND OF THE INVENTION

1. Field of the Invention

The invention pertains to garments and particularly women's swimsuits.

2. Description of the Prior Art

With the continuing trend toward naturalness and health, there has been a pronounced tendency for women of all ages and physical conditions to desire to wear substantially briefer swimsuits than those conventionally worn in the past. This trend has created problems for women who, though desiring to achieve a maximum suntan, have imperfections in skin or figure which are desired to be concealed in particular contexts. In the past, such women would have contented themselves with wearing a one-piece bathing suit, thus depriving them of the benefits of greater exposure to the sun. In particular, the spread of the desire for greater exposure while wearing swimsuits to women of more advanced ages than in the past has resulted in a larger number of women with imperfections or flaws in skin or figure, as for example, stretch marks or scars resulting from childbirth or Caesarian Section. For such women, the conventional two-piece bathing suit would reveal the flaws in particular context, as in a public bathing beach, and would cause embarrassment or distress. On the other hand, such two-piece bathing suits would prove satisfactory to such women in other contexts than the public bathing beach, as for example, around a swimming pool or with friends.

Custom-made swimsuits designed to maximize exposure of a particular woman's figure while at the same time concealing particular flaws, have been infrequent, due to their cost and accessibility to the vast majority of women.

Therefore, there has been a felt but unfulfilled need for a woman's swimsuit available in conventional sizes which can be adjusted by the wearer to provide the desired degree of exposure and concealment depending on particular circumstances in which the wearer of the swimsuit finds herself.

SUMMARY OF THE INVENTION

An adjustable swimsuit comprises an upper piece and a lower piece, the upper piece including a pair of cups and an intermediate connector section between the cup, with the connector including a first connector element. The lower piece includes a connector member with a second connecting element for connection to the first connecting element. The first connector element and the second connector member are fastenable to one another in an adjustable fashion, and the upper piece connecting section and lower piece connecting member are configured to cover selected portions of the wearer's body when the first connector element and the second connector element are connected to one another. The connecting elements are concealable in the upper and lower pieces of the bathing suit, respectively, when not in use and when maximum exposure is desired.

BRIEF DESCRIPTION OF THE DRAWINGS

FIG. 1 is a perspective view, from an anterior perspective, of an adjustable swimsuit in accordance with the invention with the respective pieces of the swimsuit connected;

FIG. 2 is a posterior perspective of an adjustable swimsuit in accordance with the invention;

FIG. 3 is a fragmentary view of an upper piece of an adjustable swimsuit in accordance with the invention;

FIG. 4 is a fragmentary view of a portion of a lower piece of an adjustable swimsuit in accordance with the invention; and FIG. 5 is an anterior perspective view of an adjustable swimsuit in accordance with the invention with the pieces disconnected for maximum exposure.

DETAILED DESCRIPTION OF A PREFERRED EMBODIMENT

As depicted in FIGS. 1, 3 and 5, an adjustable swimsuit 10 in accordance with the invention comprises an upper piece 12 in the form of a halter top, and a lower piece 14. The upper piece 12 includes cups 16 and in the embodiment depicted includes side-backstrap (best seen in FIG. 2) 18 and a neck strap 20. The neck strap 20 is provided primarily for comfort and extra support for wearers of the swimsuit who may need it. The adjustable swimsuit 10 is fabricated of somewhat resilient material but does not require the use of strongly resilient material, such as elastic, which may cause in particular women bunching up, or irritation of the skin.

The upper piece 12 further comprises an intermediate connector section 22, which may be triangular in form in the unstretched condition. As best seen in FIG. 3, the connector 22 comprises two layers 24 of material disposed around a first connecting element 26 in the form of a string or ribbon, the layers 24 and the connecting element 26 being sewn together in conventional manner.

As best seen in FIGS. 1, 4 and 5, the lower piece 14 is configured to be worn on the lower torso in conventional fashion. Lower piece 14 includes a connector portion 28 which includes a flap-like member 30 disposed at an upper section of the bottom piece 14 and further including a second connector element 32 in the form of a string or ribbon compatible with the first connector element 26. The member 30 comprises a pair of layers 34 of material with the second connector element 32 disposed therebetween, the combination being sewn together. In use, in a minimum exposure mode, as depicted in FIG. 1, the first and second connecting elements are tied together so that there is no slack. As a result, the flap 30 is pulled up to the maximum extend to provide maximum concealment for any desired purpose as, for example, to hide certain imperfections, such as scars or stretch marks on the body of the wearer. The configuration of the flap 30, and its stretchability, determine what coverage will be achieved by it when it is connected to the upper piece 12. For the common flaws and figure problems, such as stretch marks and surgical scars, the configuration depicted will provide adequate concealment. For particular flaws or blemishes located in other portions of the body, the adjustable swimsuit in accordance with the invention can be fabricated to adjust the configuration and resiliency of the flap to provide the desired coverage.

As depicted in FIG. 5, in the maximum exposure mode of use of the adjustable swimsuit 10, the upper piece 12 is completely disconnected from the lower piece 14. The flap 30, and the second connector element 32, are tucked under the remainder of lower piece 14 and, due to the thinness and resiliency of the material, produce no bulge or other evidence of their presence.

In the upper piece 12, the lower portion of the connector section 22 which includes the connector element 26 is tucked under the remaining of the connector section and, like its counterpart in the lower piece 14, has no adverse effect upon the contour of the swimsuit.

A selected coverage desired, depending on particular figure characteristics or the social context in which the suit is worn, may be achieved by adjusting the amount of slack left when the strings 26 and 32 are tied together. The longer the slack or untied portion of string 32, the lower will be the top of the flap 30 and, of course, the less concealment will be effected.

Thus, in accordance with the invention, a swimsuit has been provided which affords the capability of selective coverage and exposure based on the particular wishes of the user at any particular time, in the form of a swimsuit manufactured in conventional sizes and without necessity for custom fabrication thereof.

Though a particular embodiment of the invention has been described and depicted herein, the invention is defined solely by the appended claims interpreted in light of the specification and drawings.

What is claimed is:

1. An adjustable swimsuit comprising:

an upper piece; and a stretchable lower piece, said upper piece including a pair of cups and an intermediate connector section disposed beween said cups, said connector including a first connector element, said stretchable lower piece including a connector member including a second connecting element for connection to said first connecting element, said first connector element and said second connector element being connectable to one another to stretch said lower piece to cover selected portions of the wearer's body when said first connector element and said second connector element are connected to one another.

2. The invention as set forth in claim 1 wherein said connecting section in said upper piece comprises resilient material having a generally triangular configuration in an unstretched condition and wherein the said connecting member in said lower piece comprises a flap member having a generally triangular configuration in the unstretched condition.

3. The invention as set forth in claim 2 wherein the connecting section of said upper piece and the connector member of said lower piece are fabricated of resilient material.

4. The invention as set forth in claim 2 wherein said first connector element and said second connector element are configured such that the connection between them can be adjusted to be located at selected points of the body of the wearer affording thereby adjustable coverage by said connecting section of said upper piece and said connector member of said lower piece.

5. The invention as set forth in claim 4 wherein the connecting section of said upper piece is configured such that the first connector element can be placed thereunder and concealed when not in use and wherein said connector member of said lower piece is configured to be positionable under the remainder of the lower piece without affecting the contour thereof, when not in use.

* * * * *